US007152683B2

(12) United States Patent
Khomynets

(10) Patent No.: US 7,152,683 B2
(45) Date of Patent: Dec. 26, 2006

(54) METHOD FOR OPERATING A WELL JET DEVICE DURING CLEANING OF THE DOWNHOLE AREA OF A FORMATION AND DEVICE FOR CARRYING OUT SAID METHOD

(76) Inventor: Zinoviy Dmitrievich Khomynets, d.33, ul. Vilshanestkaya, Tismenitsa, obl. Ivano-Frankovskaya 77400 (UA)

( * ) Notice: Subject to any disclaimer, the term of this patent is extended or adjusted under 35 U.S.C. 154(b) by 0 days.

(21) Appl. No.: 10/506,525

(22) PCT Filed: Dec. 3, 2002

(86) PCT No.: PCT/RU02/00518

§ 371 (c)(1),
(2), (4) Date: Sep. 3, 2004

(87) PCT Pub. No.: WO03/076812

PCT Pub. Date: Sep. 18, 2003

(65) Prior Publication Data

US 2006/0021754 A1 Feb. 2, 2006

(30) Foreign Application Priority Data

Mar. 11, 2002 (RU) ..... 2002105995
Mar. 11, 2002 (RU) ..... 2002106128

(51) Int. Cl.
*E21B 43/16* (2006.01)

(52) U.S. Cl. ..... 166/372; 166/105; 166/106; 166/312; 166/250.01; 175/67; 175/424

(58) Field of Classification Search ..... 166/105, 166/106, 312, 250.01, 372; 175/67, 424; 417/172, 176

See application file for complete search history.

(56) References Cited

U.S. PATENT DOCUMENTS

2004/0134663 A1* 7/2004 Khomynets ..... 166/372

* cited by examiner

*Primary Examiner*—David Bagnell
*Assistant Examiner*—Giovanna Collins
(74) *Attorney, Agent, or Firm*—patenttm.us; James H. Walters

(57) ABSTRACT

The invention relates to pumping engineering, mainly to well pumping devices for extracting oil from wells. The inventive method consists in assembling from the bottom upward an input cone provided with a shank, a packer and a jet pump and in running said assembly with the aid of a tubing string into a well. Afterwards, a receiver transformer of physical fields is also run into said well, background measurements of temperature and other physical fields are carried out, a formation is drained and the work of the individual interlayer of a productive strata is evaluated. An ultrasonic action is performed on the productive strata. The hydrodynamic action being performed on the productive strata during said operation, the entire formation is exposed to the combined action of ultrasonic oscillations and a hydrodynamic effect. Afterwards, the unit for ultrasonic effect is pulled out from the well to the surface. The hydrodynamic and geophysical investigations of the well being carried out using the jet pump and replaceable functional inserts, the assembly and the jet pump are pulled out from the well to the surface and the well is prepared in order to be put into operation. The invention makes it possible to optimise the dimensions of various elements of the device, thereby increasing the operating reliability and performance of the well jet device during the treatment of the productive strata.

1 Claim, 3 Drawing Sheets

METHOD FOR OPERATING A WELL JET DEVICE DURING CLEANING OF THE DOWNHOLE AREA OF A FORMATION AND DEVICE FOR CARRYING OUT SAID METHOD

FIELD OF THE INVENTION

This invention relates to the field of pump engineering, primarily to well pump devices for extracting oil from wells.

PRIOR ART

Known in the art is a method of operating a well jet device, which comprises supply, via the tubing string, an active liquid medium to the nozzle of a jet device, wherein the said liquid medium entrains a passive medium and mixes with it while supplying the mixture of the media out of a well to the surface (RU 2059891 C1).

Known from the same source is a well jet device, which comprises a jet pump being installed on the tubing string in a well, and a geophysical instrument being arranged in the tubing string below the said jet pump.

The known method of operation and the well jet device enable to pump out of a well various extracted media, e.g., oil, with the simultaneous treatment of the extracted medium and the downhole area of a formation.

But, the said method does not provide for a possibility of selectively acting on the downhole area of a formation. Furthermore, the said device does not provide for a possibility of installing various functional inserts, what, in a number of cases, narrows the field of application of the said method of operation and the said device.

The closest to the present invention as to the technical essence and the achieved result in respect of the method is a method of operating a well jet device while treating a formation, the said method includes installing, in a well on the tubing string, a jet pump arranged in its case wherein the latter has a through passage made in it, supplying, via the tubing string to the nozzle of the said jet pump, a working medium, and creating owing to it a regulated pressure in the under-packer area with the possibility of draining the formation and carrying out other maintenance works (RU 2176336 C1).

The closest to the present invention as to the technical essence and the achieved result in respect of the device is a well jet device, known from the same source, which comprise a packer, a tubing string and a jet pump, the case of the said pump comprising an active nozzle with a mixing chamber, and a through passage being made with a mounting face for installing a sealing assembly with an axial channel, the said device being provided with an irradiator and receiver-transformer of physical fields, which is arranged on the jet pump side for entry of the medium pumped out of the well and is installed on the cable passed through the axial channel of the sealing assembly, the passage for supplying the active medium is connected to the tubing string above the replaceable functional insert, the input side of the jet pump's passage for supplying the extracted medium is connected to the tubing string below the replaceable functional insert, and the output side of the jet pump is connected to the tubing string hole clearance.

The known method of operation and the well jet device enable to treat a formation in a well below the level at which the jet pump is installed, including treatment of a producing formation with chemical agents, and to create a pressure differential above and below the functional insert.

However, the said method of operation and the said well jet device do not enable to utilize the capacity of the well jet device in full, which is due to a limited number of operations for treating a formation, primarily with the use of chemically active liquid media, and to the lack of the possibility to exactly act on non-working or poorly working layers of a producing formation, as well as to non-optimal relations between the dimensions of the components of the well jet device.

DISCLOSURE OF THE INVENTION

The objective to be achieved through this invention is to raise the reliability and productivity of the well jet device when treating a producing formation owing to identifying non-working or poorly working layers of such a producing formation and exactly acting on the downhole area for restoring its permeability and removing mudding particles from the well, which foul the downhole area, as well as for optimizing the dimensions of various components of the device.

The stated objective is achieved in respect of the method due to that the method of operating the well jet device during ultrasonic cleaning of the downhole area of a formation consists in that an input cone with a shank, a packer and a jet pump, in the case of which a passage for supplying an active medium, a passage for supplying the medium pumped out of the well, and a stepped through passage with a mounting seat between the steps are made, are all installed bottom up, this assembly is lowered on the tubing string into the well, the said input cone being arranged not lower than the roof of the producing formation; after this the packer is released, and, then, a receiver-transformer of physical fields is lowered in the well through the through passage, as made in the case of the jet pump, on a logging cable or a wire together with a sealing assembly, which is arranged on the logging cable or the wire above the tip for connecting the receiver-transformer of physical fields and is installed onto the mounting seat in the through passage made in the case of the jet pump, while ensuring the possibility of reciprocal motion of the logging cable or the wire in the sealing assembly; during the process of lowering background measurements of temperature and other physical fields are conducted along the borehole from the input cone to the well bottom; then the receiver-transformer of physical fields is arranged above the roof of the producing formation; the formation is drained by supplying a liquid medium under pressure to the active nozzle of the jet pump, while several values of pressure drawdown on the formation are successively created and at each value well bottom pressures, the composition and the physical parameters of the fluid coming out of the producing formation as well as the well output are registered; then, while operating the jet pump at a set value of pressure drawdown on the formation, the receiver-transformer of physical fields is moved along the well axis from the well bottom to the input cone, during this operation the inflow profile and the parameters of the formation fluid, the well bottom pressure as well as the changes in the physical fields in the downhole area of the formation are all registered with using the measurements for assessing the work of individual layers of the producing formation and the composition of the fluid coming out of them; then the supply of the liquid medium to the jet pump is stopped, the receiver-transformer of physical fields is removed from the well together with the logging cable or the wire and the sealing assembly, then an instrument for ultrasonic action on the formation is lowered into the well on the logging cable or the wire via the tubing string, the said instrument comprising an irradiator of ultrasound, together with the sealing assembly movably arranged above it on the logging cable; the latter is installed onto the mounting seat in the through passage, and the irradiator of ultrasound is installed opposite to the producing formation; after this the producing formation is acted on by ultrasonic oscillations, first acting on its non-working layers and then on working layers while going successively from less permeable to more permeable layers and acting on each of them with not less than two ultrasonic frequencies; during the ultrasonic treatment of layers of the producing formation the latter is acted on hydrodynamically by supplying a liquid medium to the active nozzle of the jet pump according to the following scheme: creation of stepwise drawdown on the formation, keeping of the said drawdown, stepwise restoration of the hydrostatic pressure of the liquid medium at the well bottom and keeping of this pressure, wherein the time of keeping the drawdown on the formation is set to be greater than the time of acting on the formation by the hydrostatic pressure of the liquid medium, and the number of cycles of the hydrodynamic action on each layer of the formation in combination with ultrasonic oscillations should not be less than 5; and after finishing acting on each layer of the formation with ultrasonic oscillations in combination with the hydrodynamic action a control measurement of the well output is carried out while the jet pump is operated, and after finishing acting on the whole formation with ultrasonic oscillations in combination with the hydrodynamic action the instrument for ultrasonic action on the formation is removed out of the well to the surface, hydrodynamic and geophysical studies of the well are conducted with the use of the jet pump and replaceable functional inserts; then the assembly with the jet pump is taken to the surface, and the measures necessary for putting the well into exploitation are carried out.

The stated objective is achieved in respect of the device due to that the well jet device comprises a receiver-transformer of physical fields, an instrument for ultrasonic action on the formation, replaceable functional inserts and, mounted bottom up on the tubing string, an input cone with a shank, a packer with a central passage made therein and a jet pump, in the case of which the active nozzle and the mixing chamber are installed as well as the passage for supplying an active medium, a passage for supplying a medium pumped out of the well, and a stepped through passage with the mounting seat between the steps are made; in the said stepped through passage alternatively installed are the sealing assembly, which is arranged movably on the logging cable or the wire above the tip for connecting the receiver-transformer of physical fields or the instrument for ultrasonic action on the formation, and replaceable functional inserts, i.e., a depression insert and an insert for recording curves reflecting restoration of formation pressure in the under-packer area of the well with a sampler and an autonomous instrument; the said instrument for ultrasonic action on the formation comprises an irradiator of ultrasound, which is made with the possibility of irradiating ultrasonic oscillations at not less than 2 frequencies, and a pressure gauge; the diameter $D_2$ of the stepped through passage in the case of the jet pump below the mounting seat is at least 1 mm greater than the diameter $D_1$ of the instrument for ultrasonic action on the formation, and the diameter $D_3$ of the central passage in the packer is not less than the diameter $D_2$ of the stepped through passage in the case of the jet pump below the mounting seat.

An analysis of the operation of the well jet device has shown that the reliability and the productivity of the device may be increased by optimizing the succession of the actions performed during cleaning of the near-borehole area of the formation in wells, in particular during performing works with treatment of the formation ultrasonically as well as in the result of making various components of the device under strictly defined dimensions.

It has been identified that the above-said succession of actions enables to operate the well jet device in combination with an instrument for ultrasonic treatment of a producing formation most efficiently while carrying out works on intensifying the oil inflow from a producing formation due to increasing the permeability of non-working and poorly working layers of the producing formation. By studying the formation both before and after ultrasonic treatment it is possible to initially assess the technical condition of the well, the properties of the fluid extracted from the well, the condition of the downhole area of the producing formation, to identify non-working and poorly working producing layers, and to select the mode of treating the producing formation with ultrasound. After ultrasound treatment in combination with hydrodynamic action on the formation it becomes possible to assess the quality of the conducted treatment of the downhole area of the producing formation, and to select the mode of exploitation of the well. The alternating hydrodynamic action on the formation in combination with ultrasonic oscillations action on the formation enables to increase the radius of treatment of the downhole area of the formation. At a created drawdown the jet pump timely removes mudding particles from the producing formation, which foul the latter; the said mudding particles are rapidly transferred to the surface along the hole clearance around the tubing string. The use of a receiver-transformer of physical fields and functional inserts, including, in particular, a sampler and a number of autonomous instruments, which may be installed under the said functional inserts, enables to study the medium coming out of the well. At the same time, it becomes possible to control visually the amount of drawdown and obtain information on the value of the current hydrostatic pressure from the above-said autonomous instruments and the instruments installed on the logging cable. Furthermore, when exerting ultrasonic action on the formation due to changing the frequency of ultrasonic oscillations in combination with the regulated, above-described stepped alternating mode of pumping out by changing the pressure of the liquid working medium supplied to the nozzle of the jet pump it has been possible to select such mode of operation, which not only restores the permeability of non-producing layers, but also increases the permeability and, consequently, the inflow of the extracted medium (fluid) from the producing layers of the formation. It has been identified that of significance for efficient action on the formation are the stepwise transition from a drawdown onto the formation to restoration of the hydrostatic pressure, which operation is repeated in cycles, and exceeding of the time of maintaining the drawdown onto the formation in comparison to the time of exerting hydrostatic pressure of the liquid medium column, as exists in the well, on the formation. It has been also identified that the number of the said cycles of hydrodynamic action on each of the layers should not be less than 5 in order to clean the downhole area of the formation with good quality. In the course of carrying out the works on cleaning the downhole area of the formation it becomes possible to move the receiver-transformer of physical fields and the instrument for ultrasonic action on the formation along the well, and, moreover, it becomes possible to study the formation and to treat it both at the operating jet pump and when it is stopped, which enables to carry out efficient measures for intensifying the well output with ultrasonic treatment of the producing formation, while carrying out the comprehensive study and testing of the well in different modes. In the result, it has become possible to lower 1.5–2 times the lower limit of the formation permeability, to destruct the mud fill area in the non-working layers of the producing formation, and, as a consequence, to accelerate 1.2–1.6 times the works on improving the well productivity; and, moreover, the inflow profile becomes significantly smoother due to the complete coverage of the formation by acting over its thickness in the course of treating the formation with ultrasound. It is necessary to note that the succession of the actions, as described in the invention, enables to permanently monitor the course of the works on intensifying the inflow of the medium extracted from the producing formation. In particular, the obtained inflow profiles and the curves reflecting the restoration of the formation pressure enable to get an objective view of the condition of the downhole area of the producing formation, depending on the performed works on increasing its permeability.

Furthermore, in order to prevent the instruments, which are lowered along the tubing string, in particular, an instrument for ultrasonic action on the formation, from sticking and to ensure the uninterrupted operation of the well jet device the diameter $D_2$ of the stepped through passage in the case of the jet pump below the mounting seat is at least 1.0 mm greater than the diameter $D_1$ of the instrument for ultrasonic action, and the diameter $D_3$ of the central passage in the packer is at least 1.0 mm greater than the diameter $D_2$ of the stepped through passage in the case of the jet pump below the mounting seat. It has been identified that making the instrument for ultrasonic action on the formation with the outer diameter differing lesser than by 1 mm from the diameter of the stepped through passage below the mounting seat does not prevent it from sticking, since in the course of the device operation mudding particles may enter the gap between the instrument for ultrasonic action and the wall of the stepped through passage. At the same time, the said gap should be such that it may ensure flowing along it the medium extracted out of the well in the course of moving the instrument for ultrasonic action on the formation along the stepped through passage.

Thus, the set objective has been achieved—to raise the reliability and the productivity of the well jet device while treating the producing formation—owing to identifying non-working and poorly working layers of the producing formation and exactly acting on the downhole area with the restoration of its permeability and removal of mudding particles, which foul the downhole area, our of the well, as well as owing to the optimization of the dimensions of various components of the device.

DESCRIPTION OF THE PREFERRED EMBODIMENT

Figure 1:
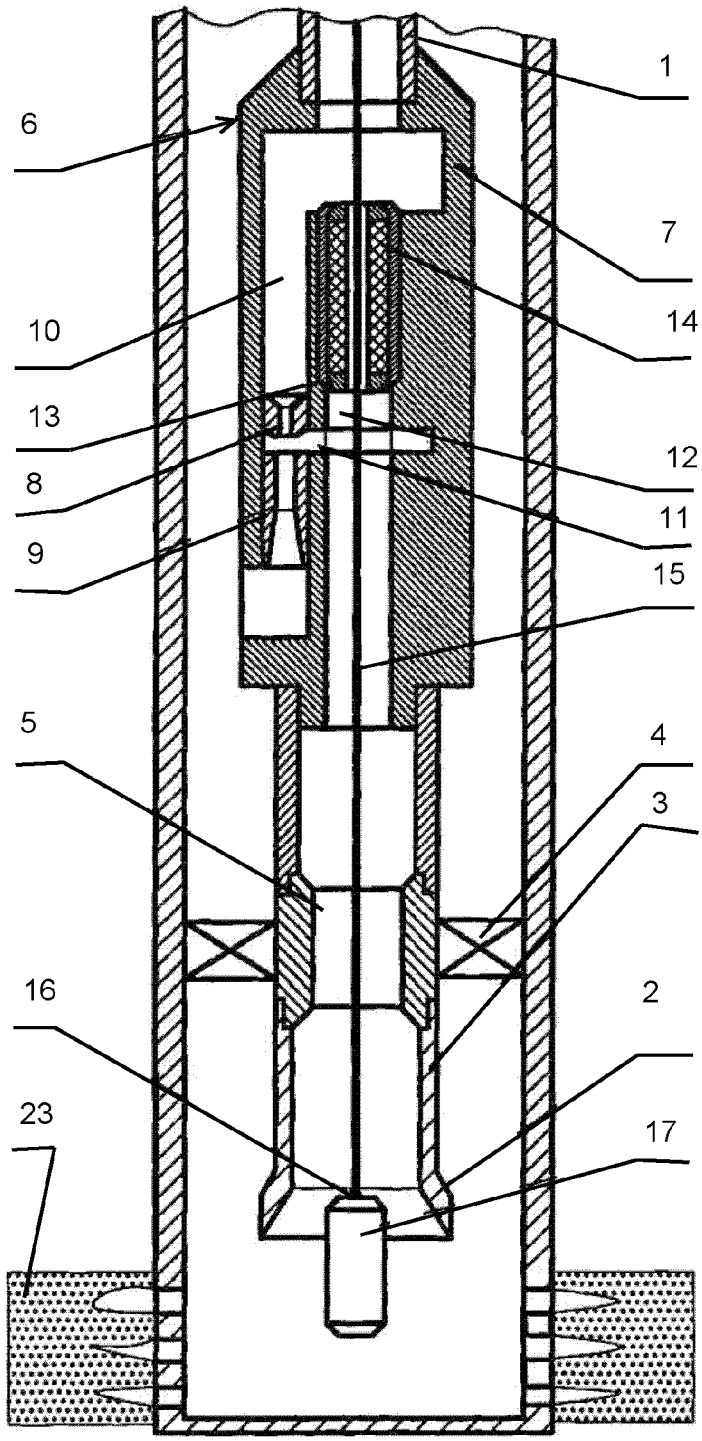
FIG. 1 represents a longitudinal section of the well jet device intended for implementing the described method of operation where the well jet device comprises a sealing assembly and a receiver-transformer of physical fields.
Figure 2:
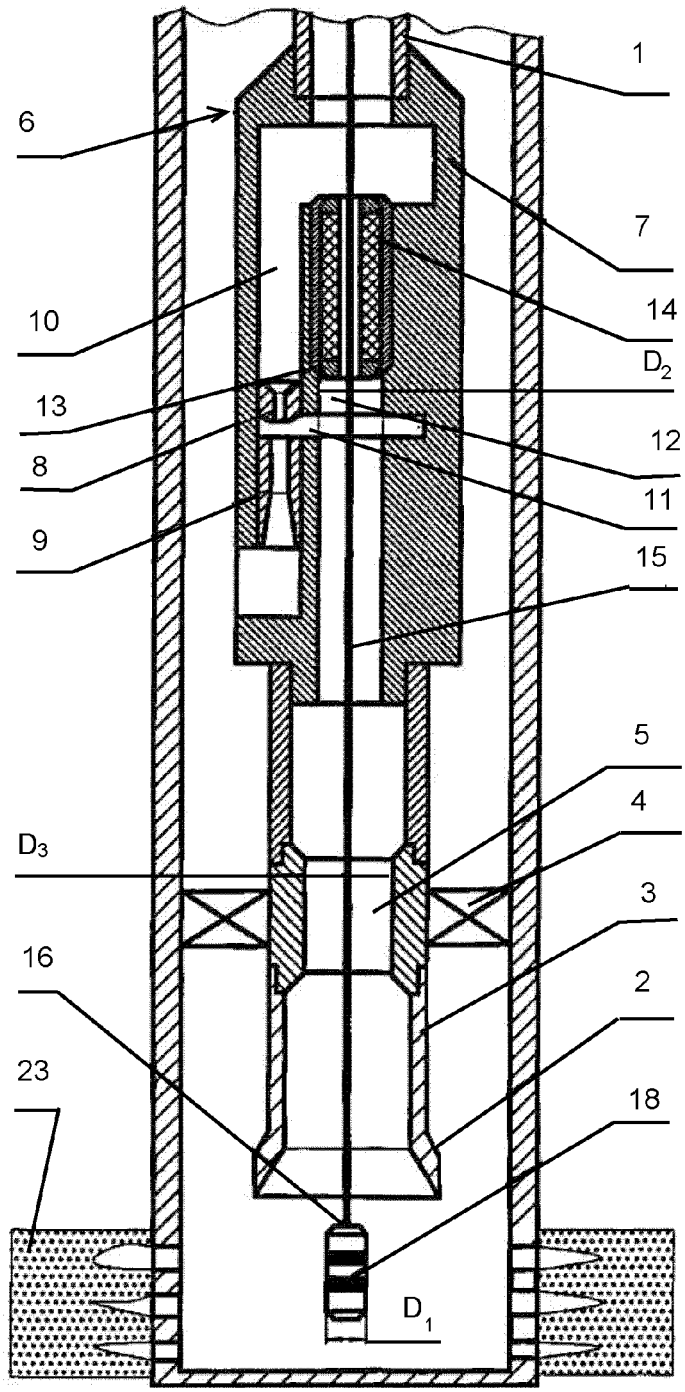
FIG. 2 is a longitudinal section of the device together with a sealing assembly and an instrument for ultrasonic action on a formation.
Figure 3:
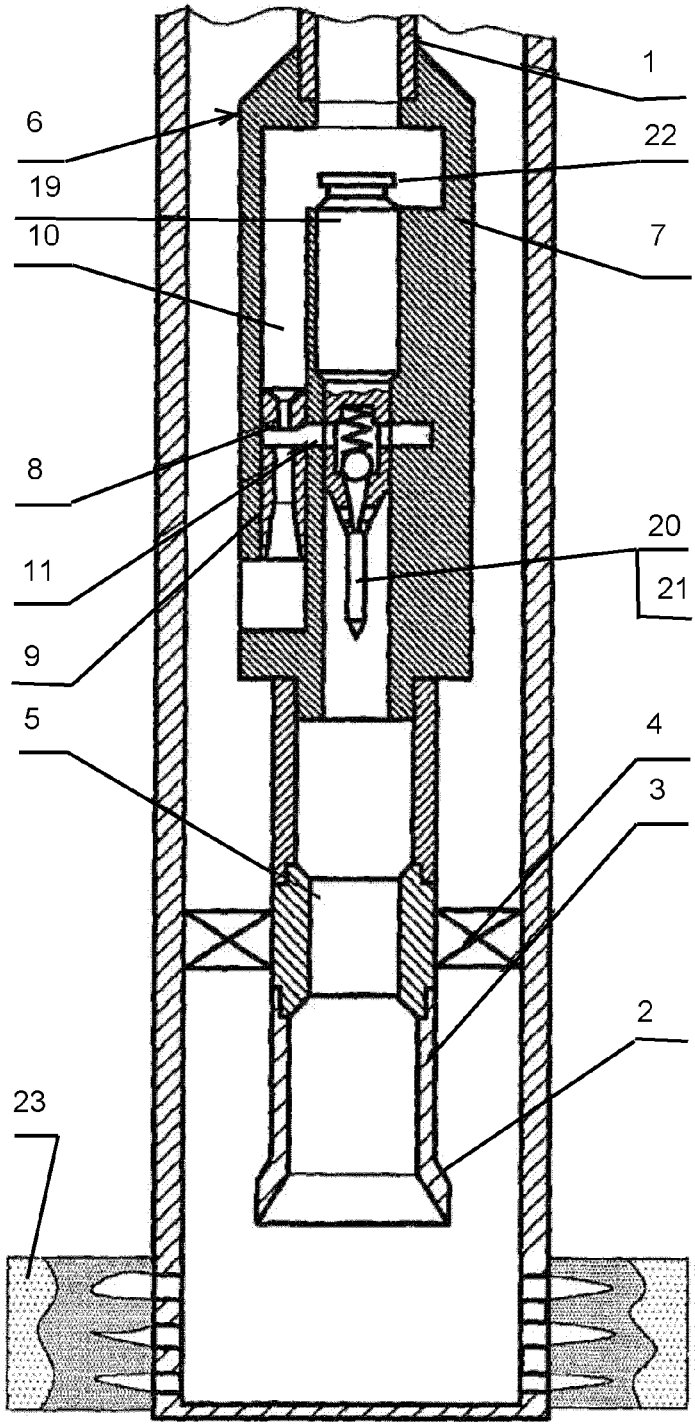
FIG. 3 is a longitudinal section of the device together with the functional insert for recording curves reflecting the restoration of foundation pressure in the under-packer area, where a sampler and an autonomous instrument are installed under the functional insert.

The well jet device comprises, mounted bottom up on the tubing string 1, the input cone 2 with the shank 3, the packer 4 with the central passage 5 made therein and the jet pump 6, in the case 7 of which the active nozzle 8 and the mixing chamber 9 are coaxially installed as well as the passage 10 for supplying an active medium, the passage 11 for supplying a medium pumped out of the well and the stepped through passage 12 with the mounting seat 13 between the steps are made, the possibility being provided for installing the sealing assembly 14, which is arranged movably on the logging cable or the wire 15 above the tip 16 for connecting the receiver-transformer of physical fields 17, the instrument 18 for ultrasonic action on the formation, and replaceable functional inserts, i.e., a depression insert and an insert for recording curves reflecting restoration of formation pressure in the under-packer area 19 of the well with the sampler 20 and the autonomous instrument 21 in the said stepped through passage. The instrument 18 for ultrasonic action on the formation comprises an irradiator of ultrasound, which is made with the possibility of irradiating ultrasonic oscillations at not less than 2 frequencies, and a pressure gauge. The diameter $D_2$ of the stepped through passage 12 in the case 7 of the jet pump 6 below the mounting seat 13 is at least 1 mm greater than the diameter $D_1$ of the instrument 18 for ultrasonic action on the formation. The diameter $D_3$ of the central passage 5 in the packer 4 is less than the diameter $D_2$ of the stepped through passage 12 in the case 7 of the jet pump 6 below the mounting seat 13. The output of the jet pump 6 is connected to the borehole clearance of the well (the tubing string 1), the nozzle 8 of the jet pump 6 is connected, via the passage 10 for supplying the active medium, to the inner cavity of the tubing string 1 above the sealing assembly 14, and the passage 11 for supplying the medium pumped out of the well is connected to the inner cavity of the tubing string 1 below the sealing assembly 14. The functional inserts are made in their upper part with the tool 22 for their installing into and extracting from the well.

The method of operating the well jet device during ultrasonic cleaning of the downhole area of a formation consists in that the input cone 2 with the shank 3, the packer 5 with the central passage 5 and the jet pump 6, in the case 7 of which the passage 10 for supplying the active medium, the passage 11 for supplying the medium pumped out of the well, and the stepped through passage 12 with the mounting seat 13 between the steps, are all installed bottom up. This assembly is lowered on the tubing string 1 into the well, the input cone 2 being arranged not lower than the roof 23 of the producing formation. The packer 4 is released, and, then, the receiver-transformer of physical fields 17 is lowered in the well through the through passage 12, as made in the case 7 of the jet pump 6, on the logging cable or the wire 15 together with the sealing assembly 14, which is arranged on the logging cable or the wire 15 above the tip 16 for connecting the receiver-transformer of physical fields 17. The sealing assembly 14 is installed onto the mounting seat 13 in the through passage 12 made in the case 7 of the jet pump 6, while ensuring the possibility of reciprocal motion of the logging cable or the wire 15 in the sealing assembly 14. During the process of lowering background measurements of temperature and other physical fields are conducted along the borehole from the input cone to the well bottom. Then the receiver-transformer of physical fields 17 is arranged above the roof of the producing formation, and the formation 23 is drained by supplying a liquid medium under pressure to the active nozzle 8 of the jet pump 6, while several values of pressure drawdown on the formation are successively created and at each value well bottom pressures, the composition and the physical parameters of the fluid coming out of the producing formation 23 as well as the well output are registered. Then, while operating the jet pump 6 at a set value of pressure drawdown on the formation 23, the receiver-transformer of physical fields 17 is moved along the well axis from the well bottom to the input cone 2, and the inflow profile and the parameters of the formation fluid, the well bottom pressure as well as the changes in the physical fields in the downhole area of the formation 23 are all registered with using the measurements for assessing the work of individual layers of the producing formation 23 and the composition of the fluid coming out of them. Then the supply of the liquid medium to the jet pump 6 is stopped, the receiver-transformer of physical fields 17 is removed from the well together with the logging cable or the wire 15 and the sealing assembly 14. Then an instrument for ultrasonic action on the formation 23 is lowered into the well on the logging cable or the wire 15 via the tubing string 1, the said instrument comprises an irradiator of ultrasound, together with the sealing assembly 14 movably arranged above it on the logging cable or the wire 15. The latter is installed onto the mounting seat 13 in the through passage 12, and the irradiator of ultrasound is installed opposite to the producing formation 23. After this the producing formation 23 is acted on by ultrasonic oscillations, first acting on its non-working layers and then on working layers while going successively from less permeable to more permeable layers and acting on each of them with not less than two ultrasonic frequencies. During the ultrasonic treatment of layers of the producing formation 23 the latter is acted on hydrodynamically by supplying a liquid medium to the active nozzle 8 of the jet pump 6 according to the following scheme: creation of stepwise drawdown on the formation 23, keeping of the said drawdown, stepwise restoration of the hydrostatic pressure of the liquid medium at the well bottom and keeping of this pressure, wherein the time of keeping the drawdown on the formation 23 is set to be greater than the time of acting on the formation 23 by the hydrodynamic pressure of the liquid medium, and the number of cycles of the hydrodynamic action on each layer of the formation 23 in combination with ultrasonic oscillations should not be less than 5; and after finishing acting on each layer of the formation 23 with ultrasonic oscillations in combination with the hydrodynamic action a control measurement of the well output is carried out while the jet pump 6 is operated. After finishing acting on the whole formation 23 with ultrasonic oscillations in combination with the hydrodynamic action the instrument 18 for ultrasonic action on the formation is removed out of the well to the surface, hydrodynamic and geophysical studies of the well are conducted with the use of the jet pump 6 and replaceable functional inserts; then the assembly with the jet pump 6 is taken to the surface, and the measures necessary for putting the well into exploitation are carried out.

INDUSTRIAL APPLICABILITY

This invention may be applied in the oil and gas producing industry and in the mining industry when developing wells after drilling, while conducting underground repair or restoration works on them for the purpose of intensifying inflow in oil and gas wells.

What is claimed is:

1. The method of operating the well jet device during ultrasonic cleaning of the downhole area of a formation, comprising installing bottom up an assembly of an input cone with a shank, a packer and a jet pump, having a case with a passage for supplying an active medium, a passage for supplying the medium pumped out of the well, and a stepped through passage with a mounting seat between steps of the stepped through passage, lowering said assembly on a tubing string into the well, said input cone being arranged not lower than a roof of a producing formation;

after said lowering step, releasing the packer, and, then, lowering a receiver-transformer of physical fields in the well through the through passage, as made in the case of the jet pump, on a logging cable or a wire together with a sealing assembly, which is arranged on the logging cable or the wire above the tip for connecting the receiver-transformer of physical fields and is installed onto the mounting seat in the through passage made in the case of the jet pump, while ensuring the possibility of reciprocal motion of the logging cable or the wire in the sealing assembly;

during the process of lowering conducting background measurements of temperature and other physical fields along the borehole from the input cone to the well bottom;

then arranging the receiver-transformer of physical fields above the roof of the producing formation;

draining the formation by supplying a liquid medium under pressure to the active nozzle of the jet pump, while several values of pressure drawdown on the formation are successively created and at each value well bottom pressures, registering the composition and the physical parameters of the fluid coming out of the producing formation as well as the well output;

then, while operating the jet pump at a set value of pressure drawdown on the formation, moving the receiver-transformer of physical fields along the well axis from the well bottom to the input cone, during this operation registering the inflow profile and the parameters of the formation fluid, the well bottom pressure as well as the changes in the physical fields in the downhole area of the formation with using the measurements for assessing the work of individual layers of the producing formation and the composition of the fluid coming out of them;

then stopping the supply of the liquid medium to the jet pump, removing the receiver-transformer of physical fields from the well together with the logging cable or the wire and the sealing assembly, then lowering an instrument for ultrasonic action on the formation into the well on the logging cable or the wire via the tubing string, the said instrument comprising an irradiator of ultrasound, together with the sealing assembly movably arranged above it on the logging cable;

installing the latter onto the mounting seat in the through passage, and installing the irradiator of ultrasound opposite to the producing formation;

after this acting on the producing formation on by ultrasonic oscillations, first acting on its non-working layers and then on working layers while going successively from less permeable to more permeable layers and acting on each of them with not less than two ultrasonic frequencies;

during the ultrasonic treatment of layers of the producing formation acting on the latter hydrodynamically by supplying a liquid medium to the active nozzle of the jet pump according to the following scheme:

creating stepwise drawdown on the formation, keeping of the said drawdown, stepwise restoring of the hydrostatic pressure of the liquid medium at the well bottom and keeping of this pressure, wherein the time of keeping the drawdown on the formation is set to be greater than the time of acting on the formation by the hydrostatic pressure of the liquid medium, and the number of cycles of the hydrodynamic action on each layer of the formation in combination with ultrasonic oscillations should not be less than 5; and after finishing acting on each layer of the formation with ultrasonic oscillations in combination with the hydrodynamic action carrying out a control measurement of the well output while operating the jet pump, and after finishing acting on the whole formation with ultrasonic oscillations in combination with the hydrodynamic action removing the instrument for ultrasonic action on the formation out of the well to the surface, hydrodynamic and geophysical studies of the well are conducted with the use of the jet pump and replaceable functional inserts;

then taking the assembly with the jet pump to the surface, and carrying out the measures necessary for putting the well into exploitation.

* * * * *